United States Patent [19]

Bramley et al.

[11] 3,975,807

[45] Aug. 24, 1976

[54] SETTING APPARATUS

[75] Inventors: Donald Bramley; Gerald Thomas Davies; David Watson, all of Doncaster, England

[73] Assignee: Imperial Chemical Industries Limited, London, England

[22] Filed: Feb. 7, 1975

[21] Appl. No.: 548,126

Related U.S. Application Data

[63] Continuation of Ser. No. 279,603, Aug. 10, 1972, abandoned.

[30] Foreign Application Priority Data

Aug. 4, 1971 United Kingdom ..... 36629/71

[52] U.S. Cl. ..... 28/1.6; 28/75 WT; 68/5 D

[51] Int. Cl.[2] ..... D02G 1/12

[58] Field of Search ..... 28/1.6, 1.7, 72.14, 28/75 WT; 68/5 D, 5 E

[56] References Cited

UNITED STATES PATENTS

| | | | |
|---|---|---|---|
| 2,924,001 | 2/1960 | Gundlach | 28/1.6 |
| 3,108,352 | 10/1963 | Haigler et al. | 28/1.6 |
| 3,343,187 | 9/1967 | Schiffer | 68/5 D |
| 3,503,104 | 3/1970 | Satterwhite | 28/1.7 |
| 3,528,149 | 9/1970 | Tambini et al. | 28/1.7 |
| 3,553,803 | 1/1971 | Buschmann et al. | 28/1.6 |
| 3,616,503 | 11/1971 | Mattingly | 28/1.7 X |
| 3,763,527 | 10/1973 | Yazawa | 28/1.6 |
| 3,780,405 | 12/1973 | Izawa et a. | 28/1.6 |
| 3,832,759 | 9/1974 | Eskridge et al. | 28/1.6 X |

*Primary Examiner*—Louis K. Rimrodt
*Attorney, Agent, or Firm*—Robert J. Blanke

[57] ABSTRACT

An apparatus for setting fiber crimp by steam in which a crimped filamentary tow is discharged from the tow exit portion of a stuffer-box crimper into an elongated tube sealed to said exit portion and control means for simultaneously regulating steam pressure and the discharge of tow from the tube depending upon the pressure of steam therein.

5 Claims, 1 Drawing Figure

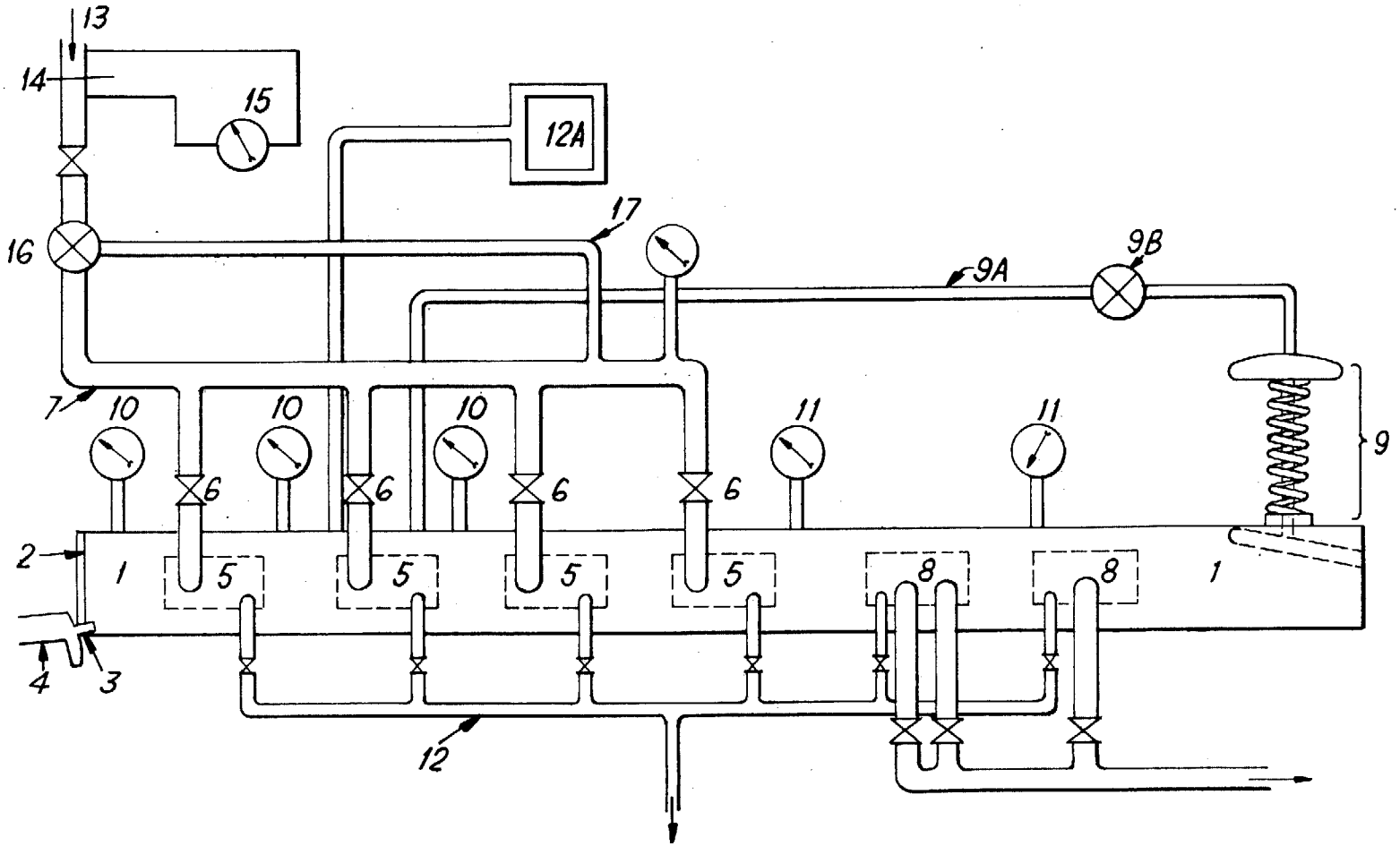
9
9B
9A
1
8
8
11
11
5
5
5
5
6
6
6
6
17
12A
10
10
10
12
15
13
14
16
7
2
3
4

SETTING APPARATUS

This is a continuation of application Ser. No. 279,603, filed Aug. 10, 1972, now abandoned.

The present invention relates to the production of crimped, thermoplastic, filamentary tow, and particularly, though not exclusively, to apparatus for the fluid setting of such tows.

In a continuous process for the crimping and subsequent fluid setting of thermoplastic, filamentary tow it is important to ensure accurate control of the fluid setting pressure since this parameter plays a significant part in determining the final bulk characteristics of the crimped tow.

In the present invention the Applicants have devised a fluid setting apparatus which is capable of providing the required degree of control of setting conditions which is necessary for the production of adequately crimped and set tow.

Thus according to the present invention the Applicants provide a fluid setting apparatus for crimped thermoplastic filamentary tow comprising an elongated tube through which the tow passes consisting effectively of three sections:

a. a fluid section in which fluid is introduced into the tube, b. a venting section in which fluid pressure is relieved to atmospheric pressure, and c. a third section from which the discharge of tow takes place, and control systems for simultaneously regulating the flow of fluid and discharge of tow.

Preferably the fluid used is saturated steam in which case condensation drains are separately provided to the sections (a) and (b), but alternatively hot air or other gases or vapours or even liquids may be employed.

A steam setting apparatus embodying the invention will now be described, by way of example only, with reference to the accompanying diagrammatic representation.

The steam setting tube 1 consists of a 6 ft. long, 2¼ inch square cross section stainless steel tube which preferably is directly attached to a tow crimping apparatus such as a stuffer-box. When attached the tube is sealed at three edges to the stuffer-box by a copper metal gasket 2. A spring loaded polytetrafluoroethylene seal 3 which allows movement of the lower doctor blade 4 in the stuffer-box is located at the remaining edge.

In approximately the first three feet of the tube from the crimping apparatus which may conveniently be termed the fluid section, saturated steam is fed through one or more of four perforated entrances 5 on each side of the tube. Each perforated entrance is connected through a valve 6, suitably by 1 inch diameter pipes, to a steam manifold 7.

In approximately the next two feet of the tube which may be referred to as the venting section, the pressure of steam from the preceding section is relieved to atmospheric pressure through similar perforations 8 to those in the fluid section. In the apparatus illustrated two perforated exits are located in each side of the tube, each open to the atmosphere through similar pipes and valves to those employed in the fluid section.

In the remaining length of the tube a pneumatically operated flap 9 connected to a closed feed-back loop 9A incorporating a control valve 9B governs the rate of discharge of set tow from the tube.

Three pressure gauges 10 are situated in the fluid section of the tube and two gauges 11 in the venting section. Condensation drains 12 are provided to each of the perforated openings in both the fluid and venting sections of the tube. A chart pressure recorder 12A may also be connected to the fluid section.

In operation, saturated steam from a main 40 p.s.i.g. line 13 flows through an 0.866 inch diameter orifice plate 14 while a differential pressure gauge 15 measures the pressure drop, and hence the steam flow rate across the plate. The steam then passes through a preset control valve 16 into the steam manifold before entering the tube.

For crimped tow derived from polyhexamethylene adipamide the Applicants prefer to maintain a saturated steam pressure of substantially 15 p.s.i.g. in the tube to ensure adequate setting and movement of the tow.

The valve 16 controls the steam pressure in the tube and this is achieved by a feed-back line 17 from the manifold to the valve. The valve is initially set by isolating the manifold from the tube and then adjusting the valve until the manifold pressure reaches the required operating pressure. Thus, should the steam pressure in the tube fall below the preset pressure the valve will open further to allow a greater flow of steam to the tube, while an increase in the pressure of steam in the tube above the presetting will cause the valve to close to reduce the steam flow. Changes in the rate of steam flow to the tube may be monitored by the differential pressure gauge.

The steam setting pressure is further controlled through the feed-back line 9A, valve 9B and flap 9. When the steam pressure in the tube falls below the setting of the valve the flap automatically closes to restrict the exit of tow and cause an increase in pressure within the tube. Conversely when the steam pressure is too high the flap will open and relieve the pressure.

In the practice of their invention the Applicants have found it necessary to set the valve 9B to a slightly lower pressure than the valve 16, since if the flap 9 is closed when the fluid flow rate is reduced by the valve 16, rejection of tow by the crimping apparatus may occur.

The pressure at the end of the venting section must be atmospheric to prevent tow being blown from the tube. This will occur if the valves in the section are insufficiently open. If the valves are opened too far, however, the drop in pressure may leave insufficient pressure to force crimped tow along the tube resulting in the possible rejection of tow by the crimping apparatus.

Though reference has been made above to the setting of crimped polyhexamethylene adipamide tow, the use of the apparatus of this invention is clearly not limited thereto and with appropriate modification of, for example, setting pressures, may be employed to fluid set a variety of thermoplastic filamentary materials, for example, as may be derived from other polyamides, polyesters, polyolefins or polyacrylics.

What we claim is:

1. Continuous steam setting apparatus for crimped, thermoplastic, filamentary tow, comprising an elongated tube through which the tow is fluidically forwarded, one end of said tube being sealed to the tow exit portion of a stuffer-box tow crimping apparatus said tube consisting effectively of:

a. a fluid section in which steam is introduced into the tube, b. a venting section in which steam pressure is relieved to atmospheric pressure, c. a third section from which the discharge of tow takes place, and d. control systems for simultaneously regulating the flow of steam and discharge of tow, said control systems comprising means for regulating the flow of steam to the tube from a source thereof, and means for simultaneously regulating steam pressure and the discharge of tow from the tube depending upon the pressure of steam therein.

2. Apparatus as claimed in claim 1 in which steam is introduced through a number of perforated entrances in the fluid section.

3. Apparatus as claimed in claim 1 in which the steam pressure is relieved through a number of perforated exits in the venting section.

4. Apparatus as claimed in claim 1 in which the discharge of tow from the third section is governed by a pneumatically operated flap.

5. Apparatus as claimed in claim 1 in which the means for regulating the discharge of tow responds to a lower steam pressure than the means for regulating the flow of steam to the tube.

* * * * *